US006427267B1

(12) United States Patent
Turner

(10) Patent No.: US 6,427,267 B1
(45) Date of Patent: Aug. 6, 2002

(54) BLANKET AND STUFFED TOY COMBINATION

(76) Inventor: Lori Turner, 69380 Campground Rd., Romeo, MI (US) 48065

( * ) Notice: Subject to any disclaimer, the term of this patent is extended or adjusted under 35 U.S.C. 154(b) by 0 days.

(21) Appl. No.: 09/836,725

(22) Filed: Apr. 17, 2001

(51) Int. Cl.[7] ..... A47G 9/00; A63H 3/00

(52) U.S. Cl. ..... 5/482; 5/485; 5/907; 446/72; 446/369

(58) Field of Search ..... 5/482, 485, 907; 446/72, 369

(56) References Cited

U.S. PATENT DOCUMENTS

| | | | | | |
|---|---|---|---|---|---|
| 1,435,159 | A | * | 11/1922 | Havens | 446/369 |
| 1,575,263 | A | * | 3/1926 | Guglielmi | 446/72 |
| 4,590,633 | A | | 5/1986 | Pickens | 5/482 |
| D290,917 | S | | 7/1987 | Rollins, Jr. | D6/589 |
| 4,750,225 | A | | 6/1988 | Simons et al. | 5/485 |
| 4,754,512 | A | | 7/1988 | Chao-Yang | 5/482 |
| D305,844 | S | * | 2/1990 | Chang | 2/69.5 |
| 5,084,930 | A | * | 2/1992 | Gugliemi | 446/73 |
| D328,665 | S | | 8/1992 | McNaughton | D2/25 |
| 5,172,440 | A | | 12/1992 | Ming | 5/485 |
| D375,427 | S | | 11/1996 | Yeh | D6/598 |
| 5,638,561 | A | * | 6/1997 | Sperry et al. | 446/72 |

* cited by examiner

*Primary Examiner*—Michael F. Trettel
(74) *Attorney, Agent, or Firm*—Gifford, Krass, Groh, Sprinkle, Anderson & Citkowski, P.C.

(57) ABSTRACT

A blanket and stuffed toy combination including a blanket having a front and back side, a first and second end, and a stuffed toy having a first portion affixed to the first end of the blanket, a second half affixed to the second end of the blanket and a rear portion affixed to the back of the blanket. In an alternative embodiment, the first and second portions of the stuffed animal define first and second interior chambers. When folded, portions of the blanket can be received into the first and second interior chambers such that the invention substantially resembles a complete stuffed animal.

12 Claims, 2 Drawing Sheets

BLANKET AND STUFFED TOY COMBINATION

BACKGROUND OF THE INVENTION

1. Field of Invention

The present invention relates to a blanket and stuffed toy combination. More particularly, the present invention concerns a blanket having portions of a stuffed toy affixed to the opposite ends of the blanket.

2. Reference to Related Art

It is not uncommon for young children to spend many hours sleeping. A warm blanket, or similar covering, and a cuddly stuffed toy are items that are commonly found in a child's bedroom. A child's blanket may present images of a favorite animated or nursery rhyme character while a stuffed toy may be anything from a fuzzy little teddy bear to a quilted child-like figure. These items are generally provided separately and purchasers may have to spend additional time and money in acquiring them as opposed to a single item. Further, the prospect of reducing the number of accessories in a child's bedroom or travel bag could be an attractive purchasing incentive for those seeking to obtain these items for a child.

SUMMARY OF THE INVENTION

The present invention concerns a blanket and stuffed toy combination that primarily serves as a bedding item when unfolded and a stuffed toy when folded. A preferred embodiment of the invention includes a blanket having a front and a back side, a first and second end, and a stuffed toy having a first portion affixed to the first end of the blanket and a second portion affixed to second end of the blanket. Preferably, the first portion of the stuffed toy is an upper torso that includes a head, an upper body, and arms while the second portion is a lower torso that includes legs. Further, a rear portion such as a rump or tail end of a stuffed toy may be affixed to the back side of the blanket to give a more complete appearance.

Another embodiment of the invention includes a blanket having the first and second portion of a stuffed toy affixed to its first and second ends wherein the first half and second portion of the stuffed toy define first and second interior chambers. The interior chambers are adapted to receive folded portions of the blanket therein such that, upon folding and disposing the blanket into the first and second interior chambers, the invention substantially resembles a stuffed toy. Preferably, the first and second portion of the stuffed toy include a securing means to secure the two halves together to further provide and maintain the outward appearance of a stuffed toy.

Additionally, this embodiment allows the first half of the stuffed toy to be used as a hand puppet when the blanket is unfolded to entertain or amuse the child.

DETAILED DESCRIPTION OF THE INVENTION

Figure 2:
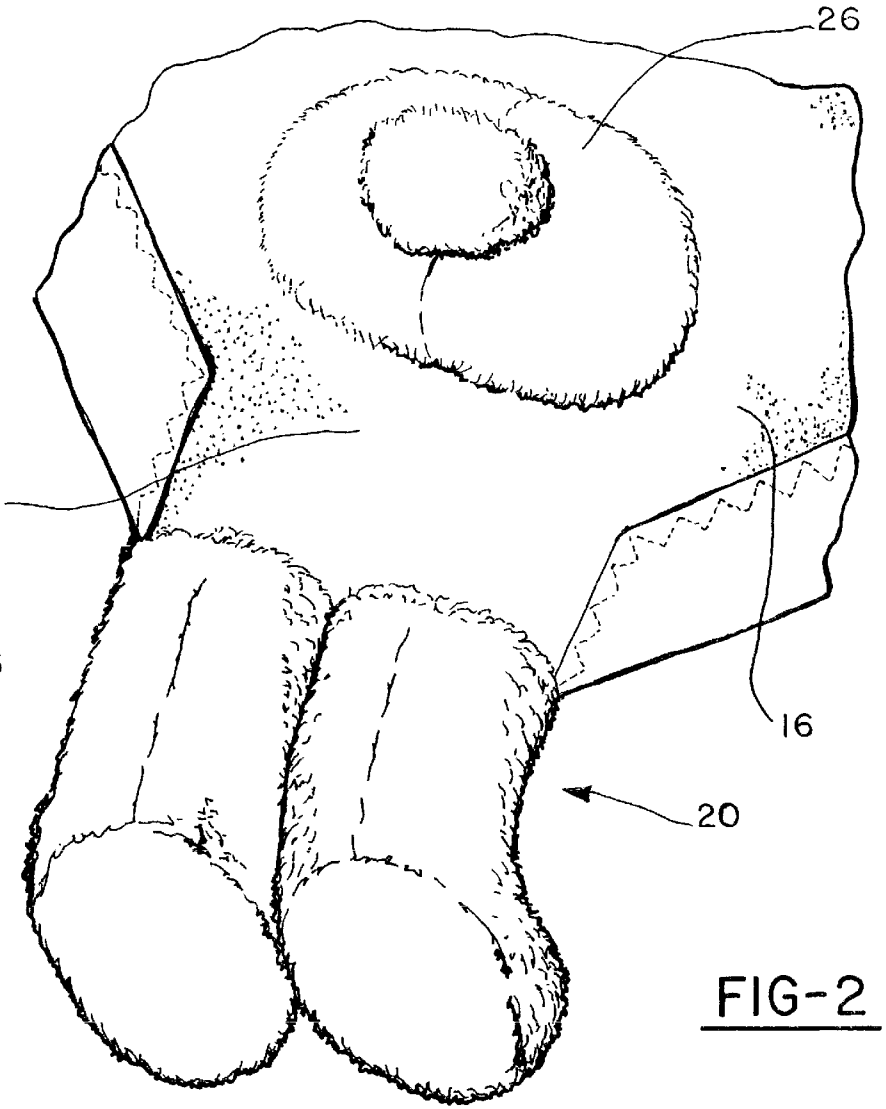
FIG. 2 is a perspective view showing the back lower side of the preferred embodiment of FIG. 1.
Figure 1:
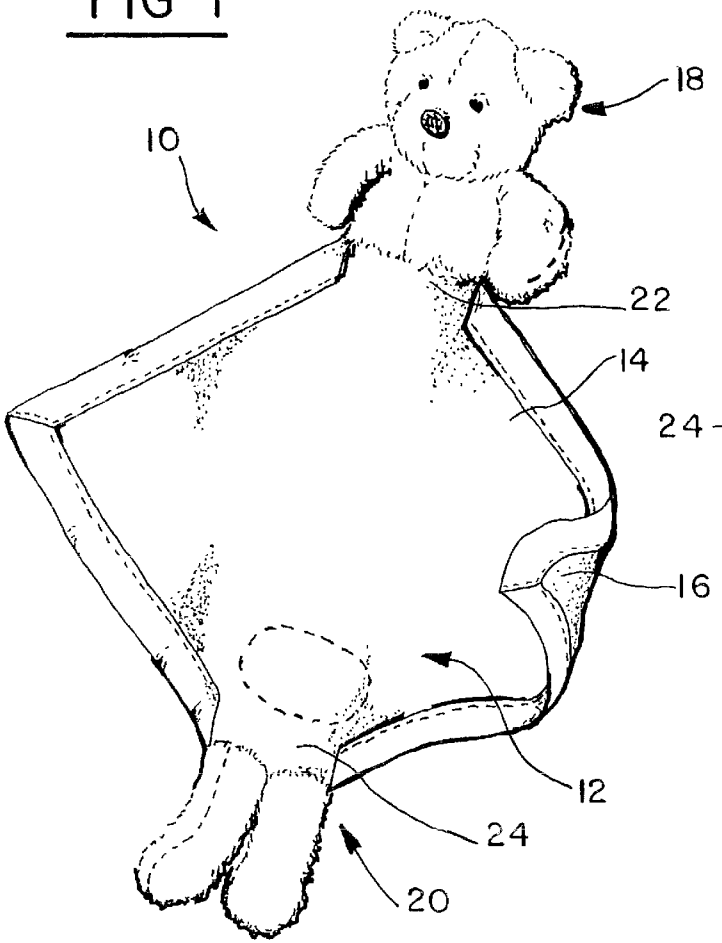
FIG. 1 is a perspective view of a preferred embodiment of a blanket and stuffed toy combination constructed in accordance with the present invention.

Referring now to FIGS. 1 and 2, there is shown a preferred embodiment of a blanket and stuffed toy combination 10 constructed in accordance with the present invention. Preferably, the present invention includes a blanket 12 having a front side 14 and back side 16 and at least a pair of ends. A first portion 18 of a stuffed toy is preferably affixed to one end 22 of the blanket 12 and a second portion 20 of the stuffed toy is affixed to the other end 24 of the blanket 12. A rear (or rump or tail) portion 26 of a stuffed toy is also preferably affixed to the back side 16 of the blanket near the second portion 20.

Still referring to FIGS. 1 and 2, the blanket 12 of the present invention is preferably a conventional fabric blanket such as would be used by an infant, toddler or small child. Therefore, it should be appreciated that the blanket 12 of the present invention may be manufactured from a variety of materials including cotton, wool and cotton-poly blends. However, more exotic fabrics such as silk may also be used in connection with the present invention. The blanket 12 may be of any shape (e.g. square, circular, rectangular, oval, etc.) or size. Additionally, as used in this application, the term blanket is intended to be used broadly and necessarily includes padded or stuffed blankets as well as pillows.

Preferably, the first 18 and second 20 portions of a stuffed toy are affixed to each end of the blanket 12. In the event the blanket 12 is circular, oval or does not otherwise have two defined ends, it is preferred that the portions of the stuffed toy be affixed in opposing positions on the blanket (e.g., at opposing points along the diameter of a circle). Preferably, the portions 18, 20 of the stuffed toy are securably affixed to the ends 22, 24 of the blanket 12 by sewing or other conventional method. However, it is appreciated that the stuffed toy portions may also be removably affixed to the blanket 12 through the use of hook and loop fasteners (e.g., VELCRO®), buttons or the like.

The stuffed toy portions 18, 20 may be constructed of and stuffed with most any material. However, it is preferred that conventional fabrics such as velvet, cotton, or traditional fabric blends be used in constructing the exteriors of the stuffed toy portions 18, 20. Furthermore, the stuffed toy portions 18, 20 may be stuffed with conventional stuffing material such as foam pellets, cotton, lint or goose down.

Still referring to FIGS. 1 and 2, in the preferred embodiment 10, the first portion 18 of the stuffed toy is an upper half of a teddy bear including the upper torso with the upper body, arms and head. Likewise, it is preferred that the second portion 20 include the lower half of the teddy bear including the lower body and a pair of legs. However, it should be appreciated that the lower half of a particularly small teddy bear may only include a pair of legs. Furthermore, while a teddy bear is shown as a preferred embodiment 10, other animals and things (e.g., a mouse, cow, fish, snake, turtle, ferret, person, car, truck, etc.) may also be used as the stuffed toy.

Referring now to FIG. 2, the preferred embodiment 10 of the present invention also preferably includes a rear 26 (a rump or tail portion) of the stuffed toy affixed to the back 16 of the blanket 12. Preferably, the rear portion 26 is constructed in a manner similar to the above-described constructions for the first 18 and second 20 portions.

Figure 4:
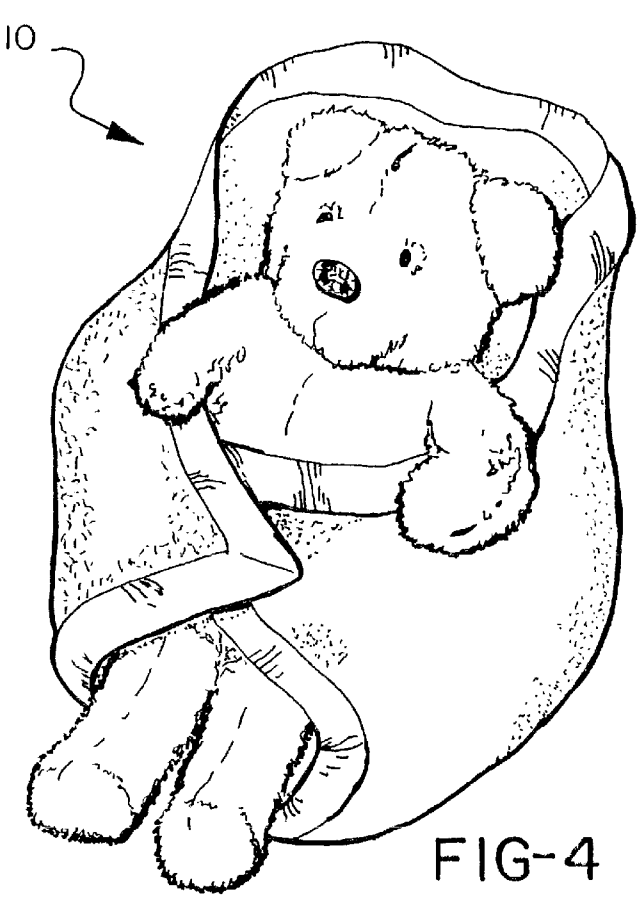
FIG. 4 is a still further perspective view of the alternative embodiment of the present invention.
Figure 3:
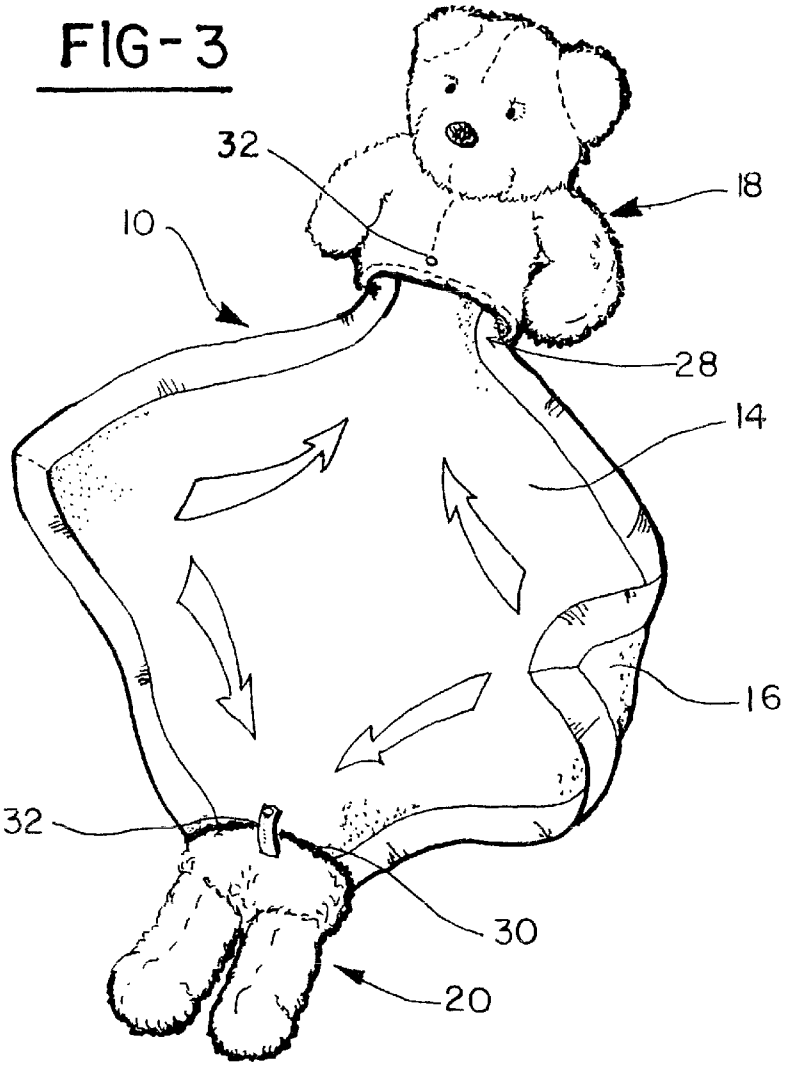
FIG. 3 is an alternative embodiment of the present invention.

Referring now to FIGS. 3 and 4, there is shown an alternative embodiment 10' of the blanket and stuffed toy combination apparatus of the present invention. As discussed above, the alternative embodiment 10' of the invention also includes a blanket 12 having a front 14' and back side 16' and a first 18' and second 20' stuffed toy portion and may include a rear portion 26'. Additionally, as best shown in FIG. 3, the first 18' and second 20' stuffed toy portions of the alternative embodiment 10' respectively include a first 28 and second 30 interior chamber. Preferably, the ends of the blanket 12' of the alternative embodiment 10' are secured to at least a portion of the perimeter of the first 28 and second 30 interior chambers. Therefore, in operation the blanket may be folded into the interior chambers of the first 18' and second 20' portions 18', 20' and the portions secured together by a fastener 32 (e.g., a hook and loop fastener or buttons) disposed on the first 18' and second 20' portions to create the outward appearance of a complete stuffed toy. Conversely, the fastener 32 may be undone and the blanket, with attached stuffed toy portions, unfurled for use.

It should also be appreciated that the first 18' and second 20' portions of the stuffed toy having first 28 and second 30 chamber may be adapted for use as hand puppets such that the stuffed toy portions may be useful in amusing a child. This is accomplished by inserting a hand into the first interior chamber of the first half of the stuffed toy. Preferably, the first portion is in the form of an upper torso wherein fingers can be used to move the head and arms.

Having thus described the present invention, various modifications and improvements will become apparent to those having skill in the art which do not depart from the scope of the present invention.

I claim:

1. A blanket and stuffed toy combination comprising:

a blanket, said blanket having a front side and a back side and at least a first and second end; and a stuffed toy, said stuffed toy being separated into a first portion and a second portion, said first portion being secured to said first end of said blanket and said second portion being secured to said second end of said blanket.

2. The blanket and stuffed toy combination of claim 1, wherein said first portion of said stuffed toy is an upper torso.

3. The blanket and stuffed toy combination of claim 2, wherein the upper torso includes a head, an upper body, and a pair of arms.

4. The blanket and stuffed toy combination of claim 1 wherein the second portion of the stuffed toy is a lower torso.

5. The blanket and stuffed toy combination of claim 4 wherein the lower torso includes a pair of legs.

6. The blanket and stuffed toy combination of claim 1, further comprising a rear portion being affixed to said back side of said blanket.

7. The blanket and stuffed toy combination of claim 1, wherein said first portion of said stuffed toy defines a first interior chamber and said second portion of said stuffed toy defines a second interior chamber.

8. The blanket and stuffed toy combination of claim 7, wherein said first portion of said stuffed toy comprises a hand puppet.

9. The blanket and stuffed toy combination of claim 7, wherein said second portion of said stuffed toy comprises a hand puppet.

10. The blanket and stuffed toy combination of claim 7, further comprising a fastener disposed on said first and second portions for securing the first portion of the stuffed toy to the second portion, whereby the blanket is foldable into the first and second interior chambers of the first and second portions of the stuffed toy and the first portion is secured to the second portion to provide an outward appearance of a complete stuffed toy.

11. A blanket and stuffed toy combination comprising:

a blanket, said blanket having a front side and a back side and at least a first and second end; and a stuffed toy, said stuffed toy being separated into a first portion and a second portion and a rear portion, said first portion being secured to said first end of said blanket and said second portion being secured to said second end of said blanket and said rear portion being secured to said back side of said blanket.

12. A blanket and stuffed toy combination comprising:

a blanket, said blanket having a front side and a back side and at least a first and second end; and a stuffed toy, said stuffed toy comprising a first portion and a second portion and a rear portion, said first portion defining a first chamber and said second portion defining a second chamber, said first portion being secured to said first end of said blanket, said second portion being secured to said second end of said blanket and said rear portion being secured to said back side of said blanket.

* * * * *